United States Patent [19]

Goldberg

[11] Patent Number: 4,485,333

[45] Date of Patent: Nov. 27, 1984

[54] VAPOR DISCHARGE LAMP ASSEMBLY

[75] Inventor: Seymour Goldberg, Boston, Mass.

[73] Assignee: EG&G, Inc., Wellesley, Mass.

[21] Appl. No.: 372,837

[22] Filed: Apr. 28, 1982

[51] Int. Cl.[3] ..... H05B 37/02

[52] U.S. Cl. ..... 315/149; 315/150; 315/267; 315/344; 315/112; 313/607; 313/618

[58] Field of Search ..... 315/111.8, 149, 150, 315/267, 344, 112; 313/201, 234, 607, 618

[56] References Cited

U.S. PATENT DOCUMENTS

| | | | |
|---|---|---|---|
| 2,347,715 | 5/1944 | Spencer | 315/267 |
| 3,109,960 | 11/1963 | Bell et al. . | |
| 3,170,086 | 2/1965 | Bell et al. . | |
| 3,196,312 | 7/1965 | Marrison . | |
| 3,227,923 | 1/1966 | Marrison . | |
| 3,382,452 | 5/1968 | Rempel et al. . | |
| 3,443,208 | 5/1969 | Webb . | |
| 3,946,272 | 3/1976 | Young | 315/344 |
| 4,010,400 | 3/1977 | Hollister | 315/267 |
| 4,024,431 | 5/1977 | Young | 313/607 |
| 4,095,142 | 6/1978 | Murayama et al. . | |

FOREIGN PATENT DOCUMENTS 409828 6/1935 Belgium .

OTHER PUBLICATIONS

Tako et al., Japanese Journal of Applied Physics, pp. 591–598, May 1975.

Popa et al., "A Study to Identify Hydrogen Maser Failure Modes", 13 Frequency Cont. Symp. 489–491 (1976).

*Primary Examiner*—Harold Dixon

*Attorney, Agent, or Firm*—Finnegan, Henderson, Farabow Garrett & Dunner

[57] ABSTRACT

A miniaturized vapor discharge lamp assembly that includes a light transmissive bulb containing a buffer gas and a vaporizable light radiating substance such as rubidium. Lamp excitation is provided by the use of a capacitor in the lamp assembly in conjunction with an RF oscillator. The capacitor establishes a substantially longitudinal electric field which ionizes the rubidium vapor to cause emission of light. The need for an RF excitation coil is eliminated.

4 Claims, 2 Drawing Figures

VAPOR DISCHARGE LAMP ASSEMBLY

BACKGROUND OF THE INVENTION

I. Field of the Invention

The present invention relates to the field of electrodeless alkali metal vapor discharge lamps in which an optical discharge is excited by an externally-applied, high-frequency field. More particularly, this invention is directed to a lamp assembly for providing lamp excitation to produce useful spectral lines, but which eliminates the need for an excitation coil and thereby reduces substantially the size of the assembly.

II. Description of the Prior Art

Electrodeless vapor discharge lamps that produce spectral line light emission through the ionization action of electromagnetic fields upon a vaporizable alkali metal are well-known. Such vapor discharge lamp assemblies typically comprise a lamp, an excitation coil, and an oven in which the lamp and coil reside. The lamp includes a sealed bulb or envelope in which the vaporizable substance is confined along with a buffer gas. The buffer gas is commonly one of the noble gases, such as argon, neon, helium, krypton or xenon.

An alkali metal, namely rubidium, cesium, potassium, sodium, or lithium, is used as the vaporizable substance within the lamp bulb. Ionization is effected through high-frequency electromagnetic fields provided by an excitation coil which is external to and encircles the envelope of the lamp to produce a longitudinal magnetic field along the axis of the lamp bulb. As is generally understood in the art, excitation of the alkali metal vapor is occasioned by a circumferential electric field which is proportional to the time derivative of the longitudinal magnetic field. Light emission or discharge is thus maintained without the use of electrodes in the envelope. Discharge lamps of this type are comparatively simple in structure, are relatively inexpensive to build and operate, and generally have a relatively long life because of the absence of electrodes. Such lamps are efficient and stable sources of highly-resolved optical spectral line radiation.

By use of this type of vapor discharge lamp, it is possible to concentrate an optical output in a very narrow spectral band with a minimum of intensity fluctuation and noise. These lamps find utility, for example, in the operation of various high-resolution optical systems and have been used extensively in the development of commercially feasible instruments employing the principles of optical transmission monitoring of the magnetic sublevels of atoms or other quantum systems. Further, such lamps may be used as optical lamps to achieve highly-accurate control of a radio frequency signal based on the principles of atomic resonance. The signal is then used as a frequency standard.

The excitation coil which provides lamp excitation through application of high-frequency electromagnetic fields is designed to operate in the radio-frequency (RF) range and is normally wound about the longitudinal axis of a lamp bulb and at one end of the lamp bulb or envelope. This RF coil is either driven by an RF oscillator circuit or is itself part of the oscillator circuit such as the RF coil in a tank circuit of a Colpitts oscillator. While the use of an RF coil wound about the lamp envelope has proven satisfactory in operation to ionize the alkali metal vapors, there are disadvantages to its use.

An oven used in such prior art lamp assemblies is often a cylindrical shell which surrounds the lamp and RF coil and is heated by a heating element or heating coil powered by an external power supply. The heating element and oven are needed to maintain the lamp assembly at a predetermined temperature so that the alkali metal is vaporized and the vapor pressure of the vaporized alkali metal is kept at the desired level at which light emission occurs when an energizing field is applied by the RF coil. The need for an oven, however, requires that the design of the assembly be such that there is no physical distortion or damage to the RF coil and that the output of the coil is also not distorted. These demands necessitate the spacing between the oven wall and the RF coil to be sufficiently great to avoid excess loading of the coil and thus a reduction in or destruction of its effectiveness. Typically, the oven wall must be spaced from the RF coil a distance approximately equal to the radius of the coil. The end result of these conditions of construction is that the lamp assembly is made significantly larger and heavier and thus more costly than might otherwise be necessary.

SUMMARY OF THE INVENTION

It is, therefore, an object of the present invention to provide a novel alkali metal, high resolution optical spectral line, vapor discharge lamp assembly.

Another object of the present invention is to eliminate the RF excitation coil which normally surrounds an alkali metal lamp envelope, thereby effecting a reduction in the size of the envelope-surrounding oven and a miniaturization of the lamp assembly.

Additional objects and advantages of the present invention will be set forth in part in the description which follows, and in part will be obvious from the description, or may be learned by practice of the invention. The objects and advantages of the invention may be realized and obtained by means of the instrumentalities and combinations particularly pointed out in the appended claims.

To achieve the foregoing objects, and in accordance with the purposes of the invention, as embodied and broadly described herein, a high resolution optical spectral line vapor discharge lamp assembly is provided which comprises a lamp having a sealed envelope and a vaporizable alkali metal within the sealed envelope, the vapors of which becoming ionized and radiate light in the presence of an electric field. The assembly also includes a discrete capacitive means adjacent the lamp for providing an electric field within the sealed envelope and ionizing the vapors of the alkali metal to cause the vapors to radiate light from the envelope.

The aforesaid capacitive means preferably includes a generally cylindrical electrode positioned at one end of the sealed envelope, such electrode serving as one plate of the capacitive means to provide an electric field within the sealed envelope having electrical field lines which are substantially parallel to the longitudinal axis of the sealed envelope. The assembly also preferably includes an oven adjacent to and surrounding the lamp and designed to maintain a predetermined operational temperature and vapor pressure within the sealed envelope, and having a metal cylinder whose inner surface serves as the other plate of the capacitive means.

BRIEF DESCRIPTION OF THE DRAWINGS

The accompanying drawings, which are incorporated in and constitute a part of this specification, illustrate a preferred embodiment of the invention and, together with the description, serve to explain the principles of the invention.

DESCRIPTION OF THE PREFERRED EMBODIMENT

Reference will now be made in detail to the present preferred embodiment of the invention, an example of which is illustrated in the accompanying drawings.

Figure 1:
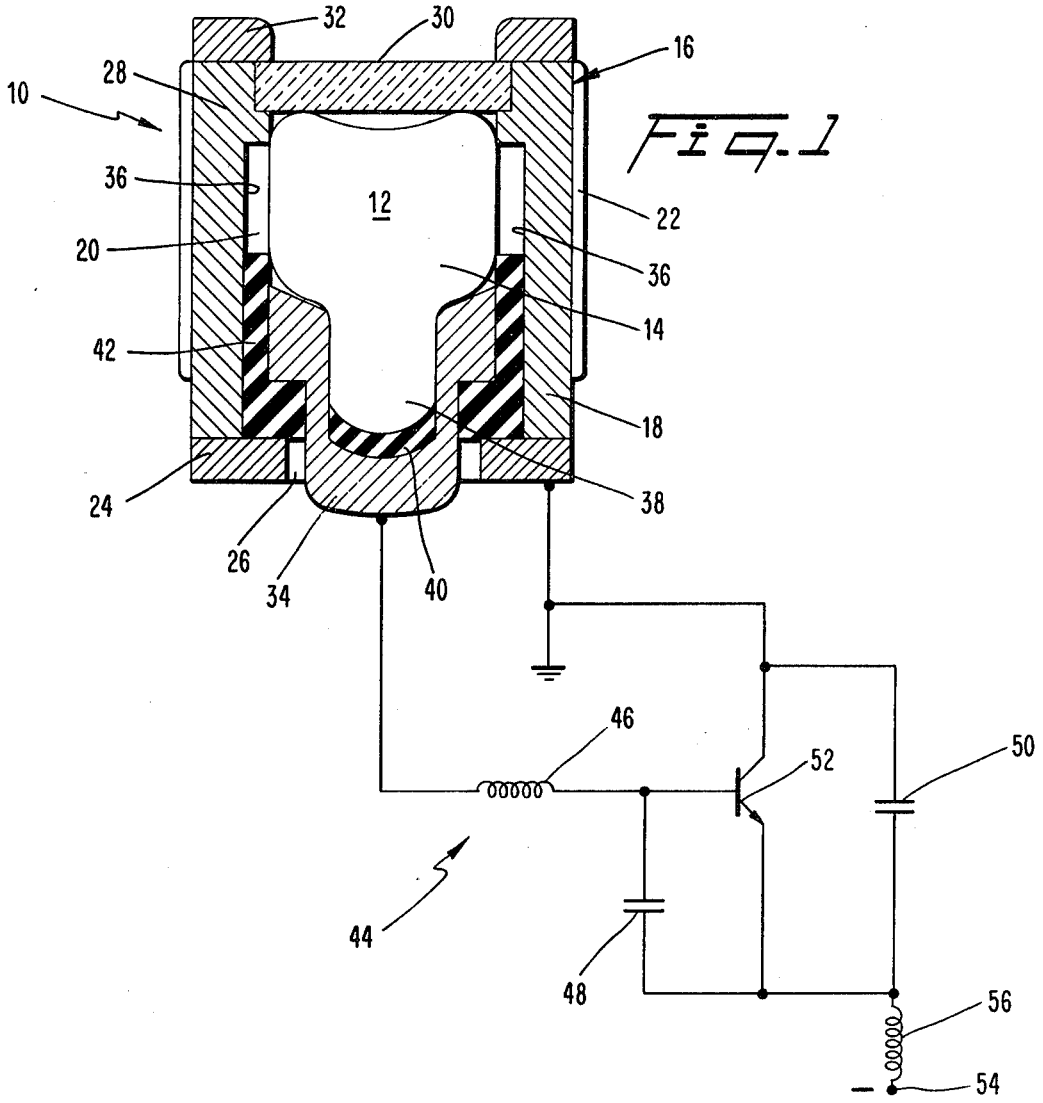
FIG. 1 shows, in cross section, an enlarged view of a preferred embodiment of a vapor discharge lamp assembly together with the schematic drawing of an oscillator circuit, constructed in accordance with the present invention.

The preferred embodiment of the vapor discharge lamp assembly is shown in FIG. 1 and is represented generally by the numeral 10. This lamp assembly includes a lamp for radiating light out of the lamp assembly. As embodied herein, lamp 12 includes a sealed envelope or bulb 14 made of a light transmissive material such as glass. Within sealed envelope 14 is an alkali metal, namely rubidium, cesium, potassium, sodium or lithium. As is well-known, alkali metals, in the presence of a field, become ionized and radiate light. Preferably, sealed envelope 14 contains rubidium. Lamp 12 also preferably contains an ionizable gas which may be one of the noble gases such as argon, neon, helium, krypton or xenon. Such noble gas facilitates the initiation of light discharge by the alkali metal vapor during operation of the lamp assembly.

As further embodied herein, the lamp assembly includes an oven, indicated generally by the numeral 16, which is formed adjacent and surrounding the lamp 12. As in the prior art, this oven is designed to maintain a predetermined operational temperature and thereby proper vapor pressure within the sealed envelope 14. The oven 16, as herein embodied, includes metal cylinder 18, which defines an oven chamber 20, and may be constructed of aluminum. The sealed envelope 14 is confined within this oven chamber. The oven also includes a heater 22 which is preferably mounted on the metal cylinder 18 for heating the oven and thereby the sealed envelope 14. Typically, the heater contains a helical coil (not shown) of insulated, high-resistance wire which is wound around the outer surface of the metal cylinder 18. The heater 22 is then connected to a source of direct current voltage (also not shown) to obtain its heating current. When sealed envelope 14 contains rubidium and a buffer gas, oven 16 is preferably operated to maintain the rubidium vapor at 100°–120° C. and the buffer gas at about 7 torr.

The bottom of cylinder 18 preferably includes an inwardly projecting, annular metal shoulder 24 which can be formed integrally with the cylinder or as a separate member, as shown here, attached to the cylinder by any suitable means. The inner annular surface of the shoulder 24 defines a circular opening 26. At the opposite top end of cylinder 18, formed on its interior surface and spaced inwardly from its top end, is preferably another inwardly projecting shoulder 28.

The lamp assembly of the present invention, as shown in the preferred embodiment of FIG. 1, also includes a window which is made of a transparent material and is aligned with the sealed envelope 14 to permit light radiated from the envelope to pass out of the assembly 10. The window 30 is preferably mounted on the oven 16 by engagement with shoulder 28 of metal cylinder 18. When seated in shoulder 28, as shown, window 30 closes the top end of the oven chamber 20, and also prevents any tendency of the lamp 12 to move longitudinally out of the oven chamber. The window can, as an example, be retained by a retaining ring 32 attached to cylinder 18 by any suitable means. Alternatively, ring 32 can be eliminated and the window 30 affixed to the recess defined by shoulder 28 by epoxy cememt or other suitable adhesives. Window 30 can be made of a standard material such as quartz or even of transparent aluminum oxide or synthetic sapphire. Preferably, window 30 is constructed of a dielectric material such as sapphire.

In accordance with the invention, there is provided discrete capacitive means adjacent the lamp for providing an electric field within the sealed envelope and ionizing the vapors of the alkali metal to cause the vapors to radiate light from the envelope. As embodied herein, the capacitive means includes a generally cylindrical electrode 34 positioned at one end of the sealed envelope 14. This electrode 34 serves as one plate of the capacitive means. The other plate of the capacitive means is formed by the inner surface 36 of metal cylinder 18. These two plates 34 and 36 form, in effect, a discrete capacitor for providing during operation, as hereinafter described, a longitudinal electric field within the sealed envelope 14. When window 30 is constructed of a dielectric material such as aluminum oxide or sapphire, it too then serves, in conjunction with inner surface 36, as part of the other plate of the capacitor.

As embodied herein, cylindrical electrode 34 is closed at one end to form the shape of a cup. Preferably, the lower end 38 of the sealed envelope 14 is of a reduced size and is retained by and within the cup-shaped electrode 34. A cushion 40 made of a material such as silicon rubber is positioned between the bottom of envelope 14 and the electrode 34 to protect the envelope against breakage. The cup-shaped electrode 34 is preferably constructed of brass and is sized so as not to extend radially beyond the surface of the upper portion of envelope 14, thus keeping small the overall size of the lamp. The bottom of electrode 34 extends down through the opening 26 of shoulder 24 so as to provide access for the connection of an oscillator circuit as described later.

Preferably positioned between the cup-shaped electrode 34 and the inner surface 36 of cylinder 18 is an insulator 42 made of Teflon or other suitable insulating material which will prevent the shorting-out of the two plates of the capacitor. Insulator 42 is generally of a cylindrical shape and is sized to provide a close fit around the cup-shaped electrode 34 so that this electrode and lamp 12 are firmly held within the oven chamber 20. The insulator 42 and the bottom of electrode 34 also serve to close off the bottom end of the oven chamber 20.

In accordance with a preferred embodiment of the invention, there is further provided an RF oscillator circuit incorporating the capacitor of the vapor discharge lamp assembly. As embodied herein, there is shown an RF oscillator indicated generally by the numeral 44. Oscillator 44 is connected to electrode 34, which protrudes outside of the oven 16 for this purpose, and to cylinder 18 by means of a ground connection to oven cylinder 18 through shoulder 24, as schematically shown in FIG. 1. Preferably, oscillator 44 is a Colpitts oscillator in which the capacitor formed of plates 34 and 36 of the lamp assembly is part of the tank circuit of the oscillator. An induction coil 46 is also connected in the tank circuit of oscillator 44 along with capacitors 48 and 50. Transistor 52 has its base connected to the junction of coil 46 and capacitor 48, its collector connected to ground and its emitter connected to bias source 54 through RF choke 56. As constructed, the Colpitts oscillator oscillates at radio frequencies to provide an RF electric field across the sealed envelope 14. Oscillator 44 can either be constructed as an integral part of the lamp assembly or as a separate circuit which is then connected to the assembly.

Figure 2:
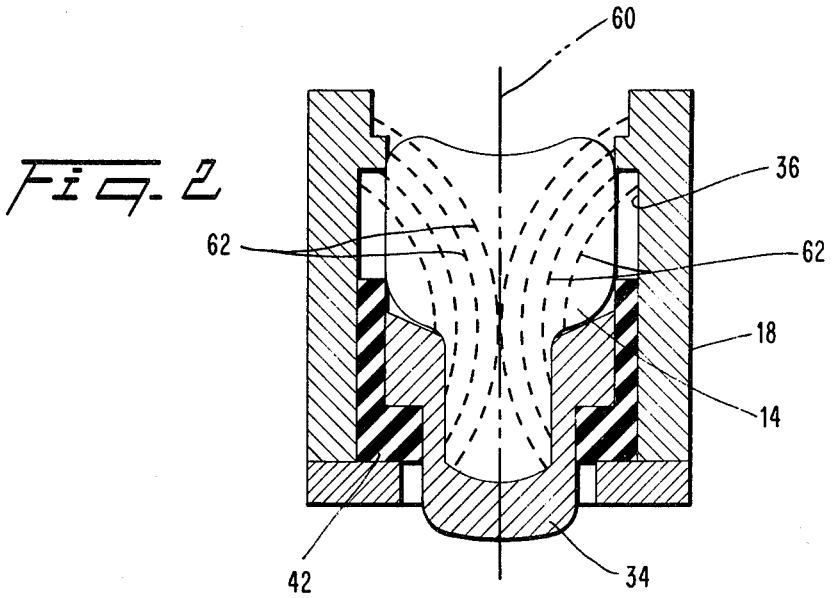
FIG. 2 shows in schematic form the preferred embodiment of the lamp assembly of FIG. 1 including the electric field lines placed in accordance with the preferred embodiment of the present invention.

With reference additionally to FIG. 2, the operation of the vapor discharge lamp assembly will be described. In FIG. 2 there is represented a schematic depiction of the lamp assembly of FIG. 1. The plates of the capacitor are represented by the interior cup surface of electrode 34 and the upper inside surface 36 of metal cylinder 18. The longitudinal axis of sealed envelope 14 along which light is projected from the assembly is designated by numeral 60. When the Colpitts oscillator of FIG. 1 is caused to operate, a longitudinal electric field is established, as shown by the lines of electric force 62 extending between the plate formed by the inside of electrode 34 and the plate formed by the upper inside surface 36 of metal cylinder 18. As seen, these field lines 62 extend longitudinally of the length of the sealed envelope 14 essentially concentric about axis 60. This electric field energizes the vaporized rubidium, for example, into an ionized state which causes it to emit light. This light is then projected by the lamp assembly out through window 30 (FIG. 1).

The use of the term "discrete" in connection with the capacitor structure of the lamp assembly of FIG. 1 is to distinguish such capacitance from the stray or incidental capacitance that might be present in electrical components such as the RF coil used in prior art structures. While a preferred form of capacitive structure has been described herein it will be obvious to someone skilled in the art that other capacitive structures can now be designed in view of the teachings of the present invention. In making such designs, it is presently believed preferable to orient the electric field lines substantially parallel to the longitudinal axis of the lamp envelope, since, contrary to popular belief, it is thought by the inventor that a significant amount of the excitation of vaporized substance within prior art alkali metal lamp envelopes is due to a longitudinal electric field of the prior art coils rather than the circumferential electric field caused by the time derivative of the longitudinal magnetic field of such devices.

No attempt has been made to describe certain of the circuits and auxillary structures conventionally found with vapor discharge lamp assemblies, as for example, the circuits or structures used to start or initiate ionization within the lamp. Similarly, the theory explaining the phenomena of vapor discharge lamps is also in the prior art. Such auxillary circuits and structures are well-known to those skilled in the art.

The circuit of the present invention shown in FIG. 1 was operated successfully at oscillator frequencies of 50 to 110 MHz, when inductances of 0.6 to 3 microhenries were used at coil 46. The lamp assembly capacitance was approximately 4 picofarads, and rubidium was used as the vaporizable substance in envelope 14. Equivalent amounts of rubidium $D_1$ and $D_2$ line output were obtained at oven temperatures of 100° C. to 125° C. as compared to the coil method of excitation.

By elimination of the RF coil within the lamp assembly and using instead a capacitive structure as described above, the concerns about coil distortion or damage by overheating or loading the coil are eliminated. The size of the oven chamber 20 is thus reduced as is the overall size of the lamp assembly. Furthermore, the heater coil 22 may be made smaller due to the decreased volume within oven chamber 20 and the reduced requirement for applied heat. Capacitive excitation, therefore, not only provides a longitudinal electric field but it permits significant size reduction while improving operating characteristics of the vapor discharge lamp.

Various constructions and modifications will become apparent to those skilled in the art in view of the teachings set forth herein, without departing from the spirit or scope of the invention. The invention in its broader aspects is therefore not limited to specific details, representative apparatus and the illustrative preferred embodiment shown and described. Thus, it is intended that the present invention cover the various constructions and modifications of this invention provided they come within the scope of the appended claims and their equivalents.

What is claimed is:

1. A vapor discharge lamp assembly for use as a high resolution optical spectral line source of light, comprising:
   (a) a lamp including:
      (i) a sealed envelope having a longitudinal axis along which light may exit that envelope, and
      (ii) a vaporizable alkali metal inside said sealed envelope;
   (b) discrete capacitive means, having two discrete electrodes located adjacent the outer surface of said envelope and having at least portions of said electrodes displaced longitudinally relative to each other, for providing within said sealed envelope an electric field which is substantially parallel to said longitudinal axis of said sealed envelope to ionize the vapors of said alkali metal and thereby cause said vapors to radiate optical spectral line light from said envelope along said longitudinal axis; and
   (c) an oven chamber for maintaining a predetermined operating temperature within said sealed envelope, said oven chamber comprising a first metal cylinder surrounding the outside of said envelope, the inner surface of said metal cylinder also serving as a first electrode for said capacitive means.

2. An assembly as recited in claim 1 wherein said capacitive means includes a second electrode positioned at one end of said sealed envelope, said second electrode comprising a second metal cylinder with one end of said sealed envelope being retained within said second metal cylinder.

3. A vapor discharge lamp assembly for use as a high resolution optical spectral line source of light, comprising:
   (a) a lamp including:
      (i) a sealed envelope having a longitudinal axis along which light may exit that envelope, and
      (ii) a vaporizable alkali metal inside said sealed envelope;
   (b) discrete capacitive means, located adjacent the outside of said envelope, for providing within said sealed envelope an electric field which is substantially parallel to said longitudinal axis of said sealed envelope to ionize the vapors of said alkali metal and thereby cause said vapors to radiate optical spectral line light from said envelope along said longitudinal axis;

(c) an oven chamber for maintaining a predetermined operating temperature within said sealed envelope, said oven chamber comprising a first metal cylinder surrounding the outside of said envelope, the inner surface of said metal cylinder also serving as a first electrode for said capacitive means;

(d) said capacitive means including a second electrode positioned at one end of said sealed envelope, said second electrode comprising a second metal cylinder with one end of said sealed envelope being retained within said second metal cylinder;

(e) wherein said second metal cylinder is closed at one end and is positioned within said first metal cylinder at one end of said first metal cylinder; and (f) wherein said assembly further comprises a cylindrical insulator surrounding said second metal cylinder and spacing said second metal cylinder from the inner surface of said first metal cylinder, said second metal cylinder and said cylindrical insulator closing one end of said first metal cylinder.

4. A vapor discharge lamp assembly for use as a high resolution optical spectral line source of light, comprising:

(a) a lamp including:

(i) a sealed envelope having a longitudinal axis along which light may exit said envelope, and (ii) a vaporizable alkali metal within said sealed envelope;

(b) an oven adjacent the outside of and surrounding said lamp, said oven including:

(i) a first metal cylinder formed outside said sealed envelope and defining an oven chamber, said sealed envelope being located within said oven chamber, and (ii) a heater mounted on said first metal cylinder for heating said oven; and (c) a discrete capacitor for providing an electrical field within said sealed envelope, said capacitor including:

(i) a first plate formed as a second metal cylinder positioned at and retaining one end of said sealed envelope, with the axis of said second metal cylinder aligned along the axis of said envelope, and (ii) a second plate formed by the inner surface of said first metal cylinder, with the axis of said first metal cylinder aligned along the axis of said envelope, and with said first metal cylinder extending beyond said second metal cylinder to provide an electric field which is substantially parallel to the axis of said envelope along which light exits said envelope.

* * * * *